United States Patent [19]

Rapids

[11] 4,176,036

[45] Nov. 27, 1979

[54] ELECTRODE FOR PORTABLE ELECTROPLATING

[76] Inventor: Felix R. Rapids, 5050 S. East End Ave., Chicago, Ill. 60615

[21] Appl. No.: 928,070

[22] Filed: Jul. 26, 1978

Related U.S. Application Data

[63] Continuation-in-part of Ser. No. 792,657, May 2, 1977, abandoned.

[51] Int. Cl.[2] ..... C25D 17/14

[52] U.S. Cl. ..... 204/224 R; 204/271; 204/292

[58] Field of Search ..... 29/509, 522; 204/224 R, 204/271, 292

[56] References Cited

U.S. PATENT DOCUMENTS

| | | | |
|---|---|---|---|
| 2,244,620 | 6/1941 | Hesse | 204/224 R |
| 2,302,967 | 11/1942 | Marsh | 29/509 |
| 2,395,348 | 2/1946 | Sherman et al. | 29/509 R |
| 2,833,702 | 5/1958 | Elfers | 204/224 R X |
| 3,525,681 | 8/1970 | Rapids | 204/224 R |
| 3,754,319 | 8/1973 | Miori | 29/522 X |

FOREIGN PATENT DOCUMENTS

| | | | |
|---|---|---|---|
| 1067504 | 10/1959 | Fed. Rep. of Germany | 29/509 R |

*Primary Examiner*—John H. Mack
*Assistant Examiner*—D. R. Valentine
*Attorney, Agent, or Firm*—Hill, Van Santen, Steadman, Chiara & Simpson

[57] ABSTRACT

A hand held plating applicator for electroplating a relatively soft metal onto a substrate consisting of an anode composed of the relatively soft metal, an electrically insulating handle, and a backing composed of a metal substantially harder than the relatively soft metal. The backing is secured to the handle, and has a plurality of countersunk apertures therein, the soft anode having integral protuberances which extend through the apertures and hold the anode in firm contact with one face of the backing. The protuberances are flattened at their ends to fill up the countersunk portions of the apertures, and provide surfaces which are flush with the opposite face of the backing.

8 Claims, 5 Drawing Figures

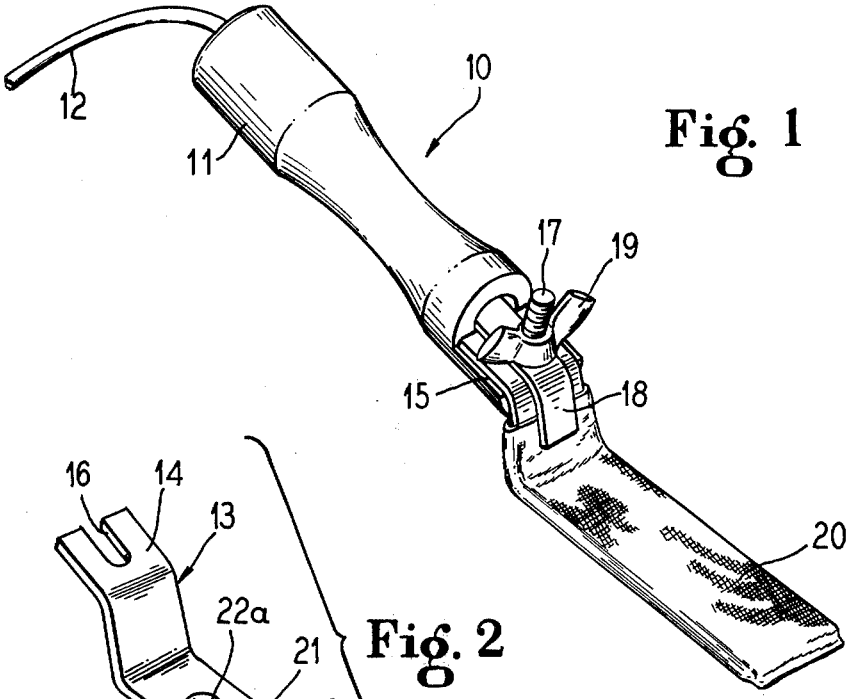
Fig. 1
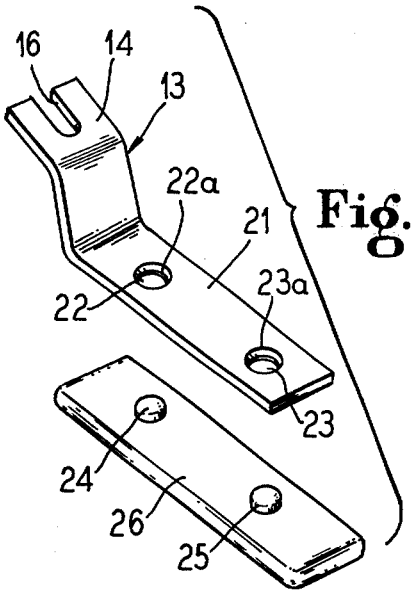
Fig. 2
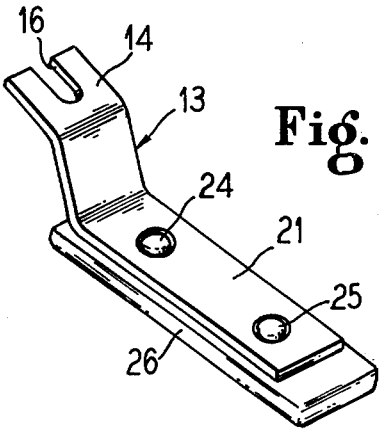
Fig. 3
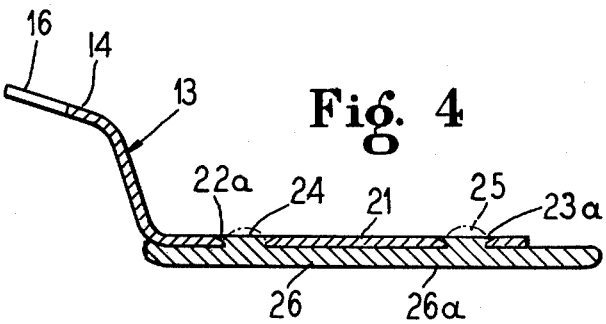
Fig. 4
Fig. 5
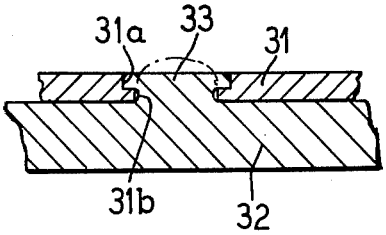

ELECTRODE FOR PORTABLE ELECTROPLATING

REFERENCE TO RELATED APPLICATION

This application is a continuation-in-part of my copending Ser. No. 792,657 entitled "Electrode for Portable Electroplating", filed May 2, 1977 now abandoned.

BACKGROUND OF THE INVENTION

1. Field of the Invention

This invention is in the field of portable electroplating applicators of the type used for the repair and maintenance of aircraft parts and the like and provides a structure which is capable of being used in narrow places. It consists of an anode structure composed of a soft metal to be plated which is locked to an overlying harder metal by flattened portions of protuberances extending from the soft metal anode through the apertures in the backing metal.

2. Description of the Prior Art

In commercial tank plating, the anode is static so that there are no problems in maintaining the shape of the anode during plating. In portable or tankless electroplating, the workpiece is static and the anode is rubbed in or on areas to be plated. This type of plating involves no real problem with harder metals such as zinc, copper and the like, which have melting points of 420° C. and more, since such metals are self-supporting and they do not require a backing to prevent bending during plating. Such anodes can be made in one piece, sheared from a sheet or plate, and require only an offset bend to accommodate a wood, plastic, or other electrically non-conductive handle containing a flexible lead. Such anode structures involve no serious problems in maintaining purity of plating.

However, using soft metals having melting points of 327° C. or less, and Brinell hardness numbers of less than 20, such as lead, cadmium, tin, and indium, provides problems because these metals require a stiff metal backing to prevent bending during plating. It is not possible, for example, to use steel rivets or bolts to secure the soft metal anode to the backing because the presence of such dissimilar metals adversely affects the plating. To prevent contamination of the platings with unwanted metals, the backing must be insoluble under all plating conditions, and under conditions of heat generated in the anode during the plating process.

Portable electroplating devices have been described in several of my previously issued U.S. patents. In U.S. Pat. No. 3,525,681 there is described an electrolytic device for applying an electric current through an electrolyte to a metal surface, the device including absorbent sleeves which hold liquid electrolyte against the anode for plating purposes.

In U.S. Pat. No. 3,746,627, there is described a method of metal electroplating for depositing a localized plating on an electrically conductive portable member. The workpiece to be plated is removably positioned on an electrically conductive current carrying cathode bar. The contact area to be plated is rubbed with a plating electrolyte-carrier to wet the area with the electrolyte and build up a plated layer.

In my U.S. Pat. No. 3,755,089, there is described a method of gold plating wherein the surface to be plated is first cleaned and activated without any current being applied by rubbing a non-displacement type of gold electrolyte solution thereon by means of a sleeve-covered anode. The plating current is then passed through the electrolyte solution during continued rubbing to effect the plating with gold on the surface as the cathode.

SUMMARY OF THE INVENTION

The present invention provides a new plating applicator for electroplating a relatively soft metal onto a substrate. The applicator includes a handle, a backing composed of a harder metal such as stainless steel or the like, having a Brinell hardness number of at least 100, with the backing member being secured to the handle. The backing member has a plurality of countersunk apertures formed therein. An anode of a relatively soft metal which can be predominantly tin, lead, cadmium, or indium, or an alloy of these metals having a Brinell hardness number of less than 20 at room temperature, is connected to the backing by means of integral protuberances formed in the anode which extend through the apertures in the backing member. The protuberances are flattened by means of hammer blows or the like to cause cold flow of the metal into the countersunk portion, resulting in a rigid connection between the soft anode and the relatively hard backing, with the protuberances filling the apertures and the protuberances having terminal portions which extend flush with the face of the backing.

The backing has an offset bend to accommodate a non-conductive handle, such as a wood or plastic handle, which carries a flexible lead. By making the terminal portion of the protuberance flush with the backing, the tool can be used for plating in narrow spaces such as in switch jaws and the like.

A further advantage of the improved anode structure of the present invention is that after the anode becomes worn in use, the portions of the anode extending through the apertures can be released from the backing with a soldering iron and a new anode can be quickly made fast to the backing with a few blows of a light hammer. The worn anodes or stubs are recovered and remelted and cast into new anodes. Thus, there is no waste of the soft metal resulting from the use of the anode.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a view in perspective of a typical plating applicator produced according to the present invention as it is used for electroplating;

FIG. 2 is an exploded view showing the manner in which the backing and the anode are combined;

FIG. 3 is an assembled view showing the anode with its protuberances extending through the apertures in the backing, but before the anode metal is cold flowed into the countersunk portions of the apertures;

FIG. 4 is a cross-sectional view of the completed anode assembly after the anode has been firmly joined to the backing member; and FIG. 5 is an enlarged fragmentary view in cross section of a modified form of the invention utilizing a different type of countersunk aperture for receiving the protuberance of the anode.

DESCRIPTION OF THE PREFERRED EMBODIMENTS

In FIG. 1, reference numeral 10 indicates generally a portable applicator according to the present invention including a handle 11 made of wood, plastic, or other electrically non-conductive material. An electrical lead 12 connects the portable plating assembly with the positive side of a power supply (not shown).

A backing member 13 composed of a relatively hard material such as stainless steel or titanium, and having a Brinell hardness number of at least 100 at room temperature, has a flat portion 14 received against a flat 15 formed in the forward end of the handle 11. A U-shaped groove 16 engages a bolt 17 which passes through the handle flat 15. A clamp 18 is suitably apertured to also pass over the bolt 17 and a wing nut 19 is used to tighten the clamp 18 and the backing member 13 against the flat 15. The forward end of the clamp 18 is received against a porous, liquid absorptive sleeve 20 with a clamping pressure which is adjusted by means of the wing nut 19. The sleeve can be composed of a suitably close knit fabric such as a polyacrylonitrile fabric or similar material which is relatively inert to the electrolyte and which is porous or otherwise permeable to or absorptive of electrolyte and capable of retaining the electrolyte in the interstices provided by the fabric. The fabric has a nap side in contact with the anode metal.

The backing member 13 has a lower flat portion 21 in which there is provided a series of apertures 22 and 23 having frusto-conical countersunk portions **22*a* and 23*a*, respectively. These apertures are arranged to be in registry with integral protuberances 24 and 25 which are formed on a soft anode block 26. The height of the protuberances 24 and 25 is sufficient, as shown in dotted outline in FIG. 4, so that they extend somewhat above the height of the apertures 22 and 23. With the upper surface of the anode block 26 securely received against the bottom surface of the backing plate 21, a few light blows from a hammer are sufficient to cause cold flow of the soft metal extending above the level of the apertures, so that the metal is forced into the countersunk portions 22*a* and 23*a* of the apertures and this metal serves to firmly unite the soft metal anode 26 to the relatively hard backing 21. The working face 26*a* of the anode 26 is thus left completely intact, and the flush engagement between the soft metal anode 26 and the backing 21** makes it possible to use the tool in close quarters without difficulty.

In the modified form of the invention shown in FIG. 5, there is provided a backing 31 which is to be secured to a soft metal anode 32. In this case, the backing has a countersunk portion consisting of a larger diameter annular portion **31*a* and a smaller diameter portion 31*b*. An integral protuberance 33 fits into the aperture with a slight excess as shown in dotted outline in FIG. 5, whereupon a slight hammering of the soft metal causes cold flow of the metal to fill the larger diameter portion 31*a* with the result that the protuberances are rendered flush with the upper surface of the backing member 31**.

In all forms of the invention, after the anodes become worn in use, the protuberances from the anode metal can be released from the backing with a soldering iron and a new anode can quickly be made fast to the backing with a few blows of a light hammer. The worn anodes or stubs are reclaimed and recast into new anodes, thus avoiding any loss of metal whatever.

In using the device of the present invention, the applicator sleeve 20 is mounted on a tin, cadmium, lead or indium anode or an anode consisting predominantly of one of the named metals. The workpiece is prepared for plating by cleaning, removing oxides, polishing, or the like. The sleeve-covered anode is then immersed into a solution of electrolyte. The portion of the workpiece which is to be plated is treated with the electrolyte-laden sleeve with rubbing but without any electroplating current being turned on. This preliminary treatment conditions the metal for subsequent reception of the plating. The plating current is then turned on after the sleeve 20 has again been immersed in the electrolyte solution, and the electrolyte proceeds with a rubbing action of the applicator on the workpiece. After plating, the work can be rinsed with water and wiped dry. If a brighter plating is desired, the plated surface can be polished with a piece of fine steel wool. The plating voltage will normally extend from about 2 volts to about 10 volts. Even at such relatively low voltages, adequate plating thicknesses can be achieved in reasonably short periods of time.

The portable applicator of the present invention can be used for the repair and maintenance of military and other aircraft, for building up commercial platings at points of greatest wear, for plating specific areas of moving parts to prevent galling or seizing, for plating contact areas of bus bars to prevent power losses, and for numerous other purposes.

It will be evident that various modifications can be made to the described embodiments without departing from the scope of the present invention.

I claim as my invention:

1. A plating applicator for electroplating a relatively soft metal onto a substrate comprising an anode composed of said relatively soft metal, an electrically insulating handle, a backing composed of a metal substantially harder than said relatively soft metal secured to said handle, said backing having a plurality of countersunk apertures therethrough, said anode being in firm contact with one face of said backing and having integral protuberances extending therefrom and exactly filling said apertures, said protuberances having flattened terminal portions extending flush with the other face of said backing by cold flow of said portions into the countersunk apertures to hold said soft metal anode into firm engagement with said backing.

2. An applicator according to claim 1, in which said soft metal has a Brinell hardness of less than 20.

3. A plating applicator according to claim 1, in which said relatively soft metal is predominantly tin.

4. A plating applicator according to claim 1, in which said relatively soft metal is predominantly lead.

5. A plating applicator according to claim 1, in which said relatively soft metal is predominantly cadmium.

6. A plating applicator according to claim 1, in which said relatively soft metal is predominantly indium.

7. An applicator according to claim 1, in which said soft metal has a Brinell hardness number of less than 20 and said backing has a Brinell hardness number in excess of 100 at room temperature.

8. An applicator according to claim 7, in which said backing in composed of stainless steel.

* * * * *